United States Patent [19]

Hurley et al.

[11] 4,265,695

[45] May 5, 1981

[54] LABELING APPARATUS

[76] Inventors: Byron H. Hurley, Rte. 1, Box 214-B, Julian, N.C. 27283; Walter G. Ricks, Rte. 1, Box 108C, Pleasant Garden, N.C. 27313

[21] Appl. No.: 48,317

[22] Filed: Jun. 14, 1979

[51] Int. Cl.[3] ..... B65C 9/02; B65C 9/10

[52] U.S. Cl. ..... 156/285; 156/497; 156/565; 156/568; 156/571; 156/DIG. 25; 156/DIG. 29

[58] Field of Search ..... 156/565, 571, 568, DIG. 29, 156/285, 497, DIG. 25, 30, 38

[56] References Cited

U.S. PATENT DOCUMENTS

| | | | |
|---|---|---|---|
| 1,153,144 | 9/1915 | Weiss | 156/DIG. 29 |
| 2,214,096 | 9/1940 | Weiss | 156/568 |
| 2,565,975 | 8/1951 | Lissimore | 156/568 |
| 2,764,408 | 9/1956 | Weiler | 156/568 |
| 2,878,953 | 3/1959 | Mitchell | 156/571 |

*Primary Examiner*—Michael G. Wityshyn

[57] ABSTRACT

The present invention consists of labeling apparatus which includes a rotatable turnstile and an oscillating label magazine. The turnstile includes vacuum means which withdraws the label from the magazine and urges it onto an object by pneumatic means.

11 Claims, 11 Drawing Figures

LABELING APPARATUS

BACKGROUND AND OBJECTIVES OF THE INVENTION

Various labeling devices have been conceived and developed in past years for labeling objects such as containers and other articles as they pass along a conveyer. Most of the prior art devices are provided with a positive feed mechanism which allows the articles to be fed along the conveyer at a consistent rate and include label applicators which present the labels to the objects also at a uniform rate. In the event the conveyer stops momentarily or in the event it "skips", the labeling equipment either drops the label, causing it to be wasted, or it places two labels on the next passing article. Should the conveyer feed the objects which are to be labeled at an irregular rate, it is quite easy for prior art labeling equipment to jam, although various safeguards have been implemented to prohibit frequent jamming of the labeling machinery.

Pre-gummed labels are frequently used in an environment where excess humidity is present and can cause the gum backing on the labels to soften and adhere to the front of the next label as they are stacked prior to dispensing. The sticking problem has long plagued the industry and past remedies have been attempted with varying degrees of success.

Certain of the above-identified problems are still unresolved in the industry, and the present invention was conceived and one of its objectives is to provide labeling apparatus which will label objects directed to its turnstile in a smooth and consistent manner.

It is another objective of the present invention to provide a labeling device which includes an oscillating label magazine for supplying labels to the turnstile.

It is another objective of the present invention to provide labeling apparatus which has an extremely high operating efficiency and which is durable under high capacity requirements.

Yet another objective of the present invention is to provide labeling apparatus with a label magazine which will separate pre-gummed labels in a warm, humid environment.

Other objectives and advantages of the present invention will be made apparent as demonstrated in the following pages.

SUMMARY OF THE INVENTION AND DESCRIPTION OF THE PREFERRED EMBODIMENT

Labeling apparatus as shown herein includes a rotatable turnstile bearingly supported on a base which turns about a center post means having a fluid passageway communicating with a cavity of the turnstile. The outer surface of the turnstile which accepts labels from a label magazine has a series of apertures which, by vacuum action, draws the label from the magazine and holds it in firm contact against the surface. As the turnstile revolves, the vacuum force is diminished gradually and is nonexistent when the label is thereafter applied to the object. Also, at application the label is urged from the turnstile and against the object by fluid pressure which is directed through a cover member located above the turnstile and is passed through the cover member downwardly into the cavity of the turnstile postioned aft of the label engaging surface and out the apertures on the label engaging surface. This fluid pressure causes the label to be forced or "blown" from the turnstile onto the object. Also, the label storage magazine of the present invention oscillates about a pivot point and is driven by a pneumatic piston. The magazine includes label separating means consisting of a series of vertical teeth members and a fluid supply means which cooperatively work to insure delivery of a single pre-gummed label to the turnstile.

The oscillation of the magazine is controlled by switch means which is located in the path of the labeled object as it moves away from the turnstile.

The preferred embodiment of the present invention includes a four-sided turnstile with concave label engaging surfaces. Also included is a label magazine having a convex frontal configuration which cooperatively abuts the turnstile during label transfer. Although the preferred embodiment of the turnstile includes a concave labeling engaging surface which is suitable for application of labels to cylindrical containers, other shapes or configurations of the turnstile and label magazine could be designed as necessary to carry out the present invention.

DESCRIPTION OF THE DRAWINGS

For a more detailed description of the drawings, FIG. 1 illustrates the labeling apparatus 10 positioned next to conveyer 11 having containers 12 thereon moving in a right to left direction. Turnstile 13 is shown with arm 14 projected into the path of containers 12 which may contain, for example, syrup or other liquids. Label magazine 15 is shown in a retracted dormant position away from the turnstile 13 with piston rod 16 of air cylinder 17 fully extended. As is understood, as piston rod 16 contracts, then magazine 15 moves in an arcuate motion towards turnstile 13 pivoting about point 18. As further shown in FIG. 1, switch means 19 is placed adjacent conveyer 11 and controls the operation of stop means 20 which may be a hydraulic, pneumatic, or other suitable mechanism. Switch means 19, when contacted by a passing container, activates stop means 20 and sprayhead 21. When the container has passed out of contact with switch means 19 then stop means 20 retracts and allows the next container to precede along conveyer 11 to turnstile 13. Also shown in FIG. 1 next to conveyer 11 is sprayhead 21 which delivers a fine liquid mist to the outer surface of containers 12 for moistening the pre-gummed labels which will thereafter be applied thereto.

Figure 3:
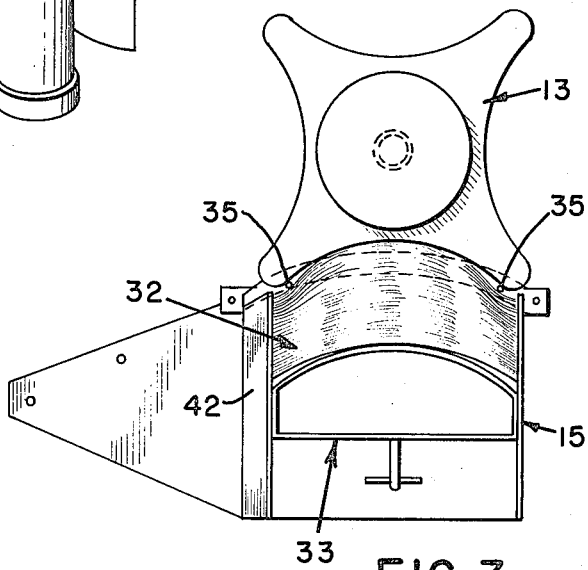
FIG. 3 is a partial top view demonstrating the label magazine in a label discharging posture in cooperative abutment with the turnstile.

Shown immediately past turnstile 13 along conveyer 11 is magazine actuating means 22 which, when activated by a container making contact therewith, causes piston rod 16 to retract thus urging magazine 15 to move in a counterclockwise path to abut turnstile 13 as shown in FIG. 3. In this position, the front most label contained within magazine 15 is withdrawn by a vacuum force which is applied through label engaging surface 23 as shown in FIG. 5.

Figure 5:
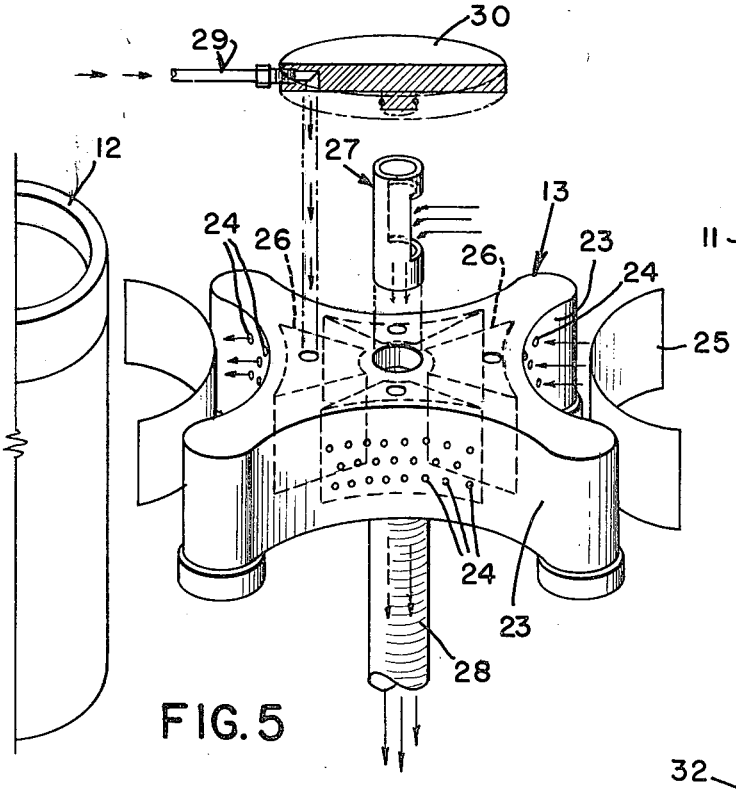
FIG. 5 is an exploded view of the turnstile.

As shown in exploded fashion in FIG. 5 turnstile 13 in the preferred embodiment has four curved label engaging surfaces 23 which include apertures 24. During label pickup from magazine 15, a vacuum force is applied to label 25 through apertures 24 whereupon label 25 is held against labeling engaging surface 23 until the vacuum action is eliminated. In order to provide a vacuum to label engaging surface 23, air is drawn through apertures 24 into cavity 26, through center post means 27 and down suction hose 28 to a suitable vacuum source (not shown). As is understood, center post means 27 remains in a fixed, stationary position and turnstile 13 rotates in a counterclockwise direction therearound. As shown, center post means 27 would diminish and terminate the vacuum force as cavity 26 moved approximately 180 degrees from the label receiving position although the exact termination point of vacuum force can be adjusted as a particular application requirement. At the point of vacuum force termination or slightly prior thereto, air pressure is applied to the label to "blow" it against the container 12 as shown in FIG. 5. The air pressure is directed from a suitable air compressor (not shown) or other source and is delivered through supply conduit 29, through cover member 30, on into cavity 26 through an opening 31 above cavity 26 and out apertures 24. This blast of air which passes through conduit 29 allows the turnstile to provide positive labeling action even if container 12 is spaced somewhat from turnstile 13. In other words, container 12 may not align itself exactly with labeling engaging surface 23 due to the container being spaced therefrom or due to an irregular shape as could be caused by damage to container 12. However, the positive air blast allows the turnstile to dispense the label and prevents jamming or the label from being wasted. The moisture content present on the surface of container 12 due to the action of sprayhead 21 assists the turnstile in positioning the label on the container when container 12 does not completely engage turnstile 13.

Figure 1:
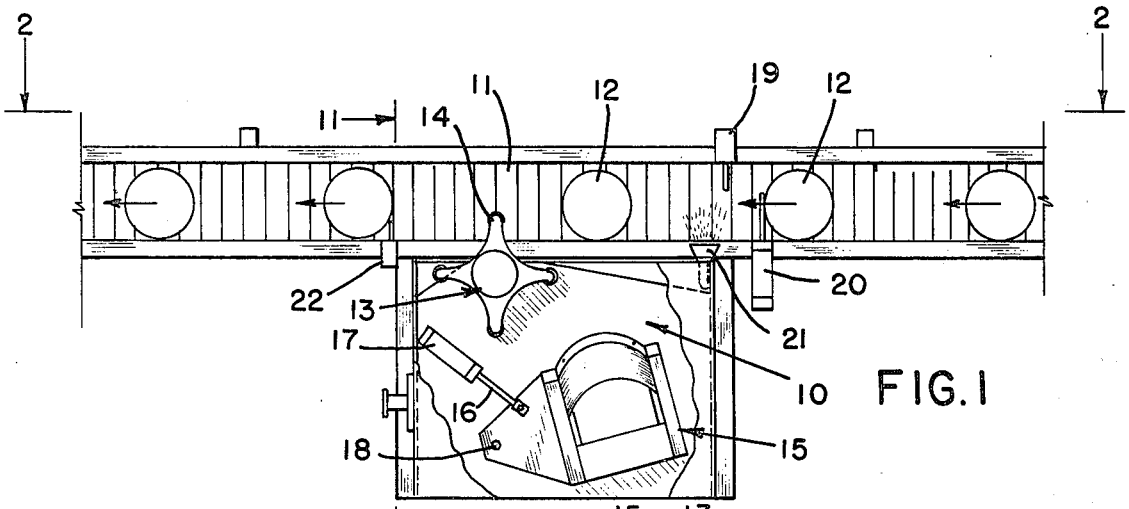
FIG. 1 is a top plan view demonstrating the present invention positioned along side a conveyer.
Figure 2:
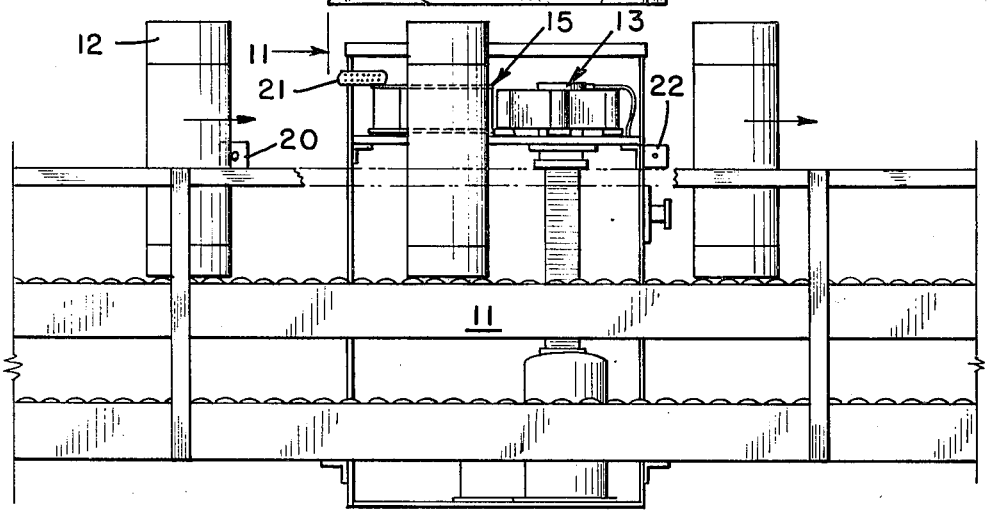
FIG. 2 is a front elevational view of the labeling apparatus substantially as shown in FIG. 1.
Figure 10:
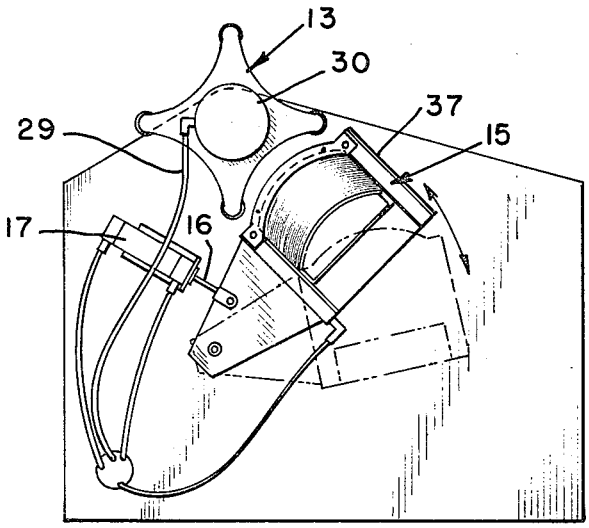
FIG. 10 is a top view of the turnstile and magazine prior to label dispersion by the magazine.
Figure 11:
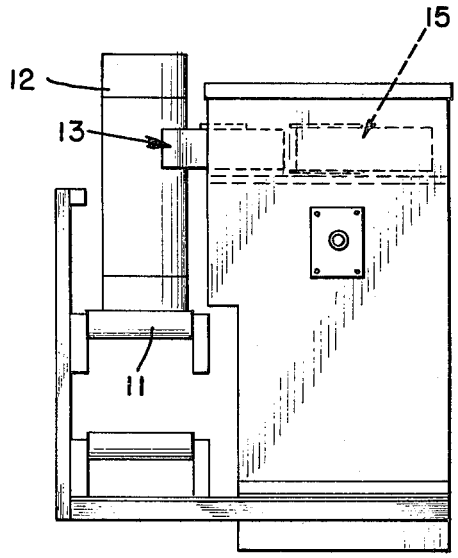
FIG. 11 is an end view of the labeling apparatus as shown in FIG. 2.
Figure 4:
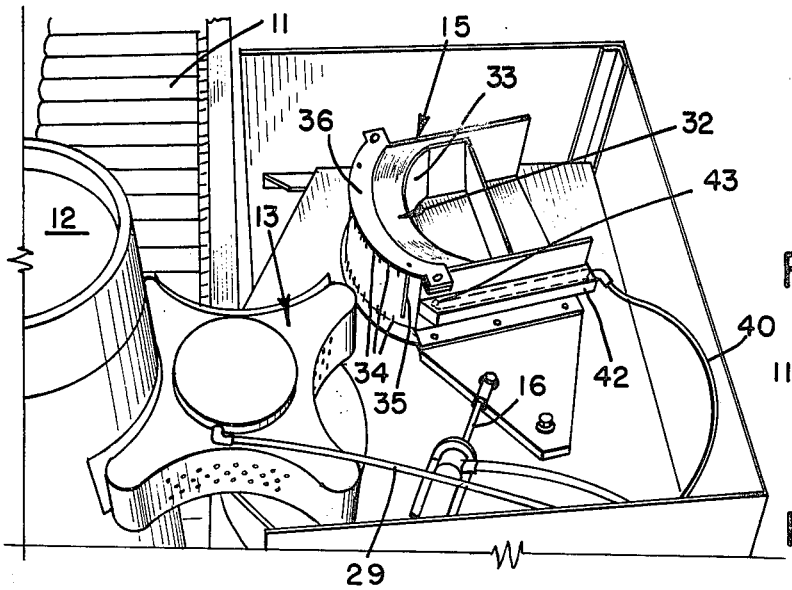
FIG. 4 is a perspective view of the magazine and turnstile in the disengaged, dormant position.

In FIG. 4 label magazine 15 is shown in its dormant position away from turnstile 13. A number of labels 32 are shown forward of label member 33 which holds labels 32 in an upright position. End retainers 35 prevent the labels from buckling and teeth members 34 act as label separating means in allowing only one label at a time to be withdrawn by the vacuum action of turnstile 13. As shown, label magazine 15 has a substantially curved frontal member 36 which allows the preferred embodiment of magazine 15 to be cooperatively received by turnstile 13 in the label receiving position of turnstile 13. Also shown in FIG. 4 as well as in FIG. 10 is fluid line 40 which provides an air supply to conduit means 42. At the terminal end of conduit means 42 is a small opening 43 on the inside wall of magazine 15. Air passes through fluid line 40 from a suitable source (not shown) under approximately 5 p.s.i. of pressure and passes through conduit means 42 and exits opening 43. This air flow assists in separating the labels during dispensing and acts as a fluid separating means.

Figure 6:
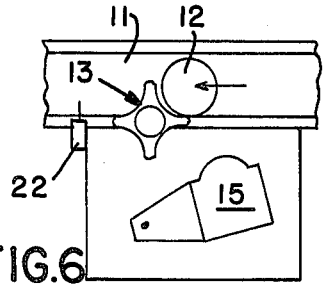
FIG. 6 demonstrates a container making initial contact with the turnstile.
Figure 7:
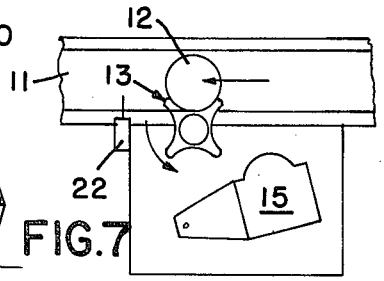
FIG. 7 demonstrates the turnstile in full engagement with the container and the label being applied thereto.
Figure 8:
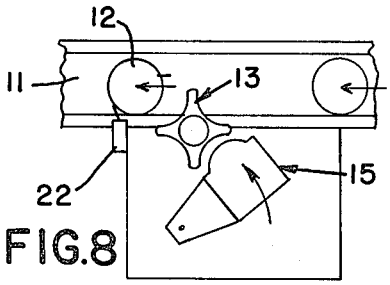
FIG. 8 demonstrates the container leaving the turnstile and the magazine moving into contact with the turnstile.
Figure 9:
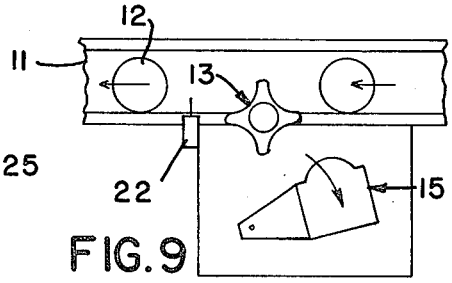
FIG. 9 demonstrates the magazine moving away from the turnstile after dispensing a label thereon.

For a step by step explanation of how the labeling apparatus of the preferred embodiment of the present invention operates, FIGS. 6–9 demonstrate the complete labeling cycle in schematic representation. As shown in FIG. 6, container 12 precedes along conveyer 11 and makes initial contact with turnstile 13. The momentum of container 12 causes turnstile 13 to rotate in a counterclockwise direction thus terminating the vacuum action applied to the label while being held by turnstile 13 and causing the label to transfer to pre-moistened container 12. Air passing through conduit 29 (not shown in FIGS. 6–9) also assists in the dispensing of the label from turnstile 13. As shown in FIGS. 6 and 7 magazine 15 is in its retracted or dormant position away from turnstile 13. In FIG. 8 the labeled container 12 has left turnstile 13 and has made contact with magazine accuating means 22 which immediately causes piston rod 16 of cylinder 17 (not shown in FIG. 8) to contract thus urging magazine 15 against turnstile 13 for delivery of another label. As soon as container 12 breaks contact with magazine accuating means 22, piston rod 16 of cylinder 17 extends causing label magazine 15 to return away from and out of contact with turnstile 13.

The smooth oscillation of magazine 15 is aided by the placement of Teflon support strip 37 which may be for example ¼ of an inch thick and may extend below magazine 15 approximately 1/64 of an inch to provide a slide member for the oscillating magazine as it moves back and forth along its base support as seen in FIG. 10.

The drawings and examples of the present invention are for illustrative purposes only and are not intended to limit the scope of the present invention.

We claim:

1. Labeling apparatus for a continuously moving object comprising: a base, a turnstile mounted of said base, said turnstile freely rotatable from a first label receiving to a second label dispensing position, said turnstile having a label engaging surface, said surface defining a fluid aperture, said turnstile having a cavity positioned aft of said surface and in fluid communication therewith, a fixed center post means, said turnstile rotatable about said post means, said post means including a fluid passageway communicating with the cavity of said turnstile when said turnstile is in the label receiving position, an upper cover member, said upper cover member including a fluid passageway communicating with the cavity of said turnstile when said turnstile is in the label dispensing position, whereby the continuously moving object rotates said turnstile.

2. Labeling apparatus as claimed in claim 1 wherein said turnstile has four label engaging surfaces.

3. Labeling apparatus as claimed in claim 1 wherein said turnstile is bearingly supported on said base.

4. Labeling apparatus as claimed in claim 1 and including an oscillating label magazine in juxtaposition to said turnstile, said magazine being mounted on said base for oscillation from a dormant to a label discharging position.

5. Labeling apparatus as claimed in claim 4 and including a fluorocarbon slide member mounted on said magazine.

6. Labeling apparatus as claimed in claim 4 wherein said magazine includes label separating means.

7. Labeling apparatus as claimed in claim 6 wherein label separating means includes vertical teeth members.

8. Labeling apparatus as claimed in claim 6 wherein label separating means includes a fluid separating means, said separating means being fixed to said magazine for oscillation therewith.

9. A method of labeling a continuously moving object comprising: placing a label on a freely rotatable turnstile by oscillating a label holding magazine into cooperative engagement with the turnstile, disengaging said turnstile and said magazine, contacting said turnstile with an object to be labeled, to thereby rotate said turnstile with the continuously moving object, and urging said label from said turnstile to the object.

10. A method of labeling an object as claimed in claim 9 wherein placing a label on a rotatable turnstile comprises applying a vacuum force to the label.

11. A method of labeling an object as claimed in claim 9, wherein urging said label from said turnstile comprises applying air pressure to the label.

* * * * *